United States Patent [19]

King

[11] 4,147,359

[45] Apr. 3, 1979

[54] GAME EQUIPMENT HAVING STEPPED RAMP MEANS

[76] Inventor: Bobby J. King, 3415 Simmons St., Oakland, Calif. 94619

[21] Appl. No.: 807,489

[22] Filed: Jun. 17, 1977

[51] Int. Cl.[2] ..... A63F 3/00

[52] U.S. Cl. ..... 273/241; 273/248; 273/287

[58] Field of Search ..... 273/241, 249, 248, 257, 273/283, 287

[56] References Cited

U.S. PATENT DOCUMENTS

| | | | |
|---|---|---|---|
| 1,208,992 | 12/1916 | Leonard | 273/249 |
| 1,553,611 | 9/1925 | Harrison | 273/249 |
| 1,615,927 | 2/1927 | Atkinson | 273/248 |
| 1,635,734 | 7/1927 | Ziegler | 273/249 |
| 3,481,606 | 12/1969 | Breslow et al. | 273/248 |
| 3,809,407 | 5/1974 | Quigley | 273/241 |
| 4,062,545 | 12/1977 | Witney | 273/246 X |

FOREIGN PATENT DOCUMENTS

| | | | |
|---|---|---|---|
| 218607 | 9/1908 | Fed. Rep. of Germany | 273/241 |
| 683651 | 3/1930 | France | 273/241 |

*Primary Examiner*—Richard C. Pinkham
*Assistant Examiner*—R. Carl Moy
*Attorney, Agent, or Firm*—Warren, Chickering & Grunewald

[57] ABSTRACT

Game equipment is disclosed which includes a chance determining spinner, a plurality of playing pieces, and ramps having a plurality of steps with side-by-side pathways defined on the steps for movement of the playing pieces along the stepped pathways in accordance with the chance determining spinner and the rules of the game. The game equipment further preferably includes three decks of cards provided with indicia indicating background information, questions relating to the background information and detriments and benefits, which decks of cards are used with the chance determining spinner in order to control movement of the playing pieces.

4 Claims, 7 Drawing Figures

GAME EQUIPMENT HAVING STEPPED RAMP MEANS

BACKGROUND OF THE INVENTION

There are numerous examples of game equipment, and particularly board games, which employ chance determining means in connection with the movement of playing pieces over a playing format during the play of a game. Most generally in connection with board games, such playing formats are two dimensional flat surfaces on which various paths, zones, indicia and the like are printed or formed and control play of the game.

Additionally, game apparatus has been evolved which also employs a vertical or height component. Typical examples of such apparatus are found in U.S. Pat. Nos. 907,421, 1,295,993, 2,839,842 and 3,905,602. While such apparatus have a vertical component in some aspect of their use or play, they are only generally similar to the apparatus of the present invention and lack the capability to symbolically represent certain real life situations, as well as educate the players at the same time.

The simulation of political activities by board games and the like has gone on for many years. The relatively recent Watergate disgrace has spawned renewed consciousness of political power as well as board games reflecting that consciousness. Typical of such games is the "Watergate Caper Game" described in the *Evening Star & Daily News* of Washington, D.C. in an article dated May 29, 1973. The Watergate Caper Game is played on a traditional flat board and is primarily satirical in nature, with the educational aspects being driven home largely through the use of irony.

The game equipment of the present invention is designed for play of a game, known as CREDIBILITY, which combines the aspects of political power struggle and abuse with a historical teaching tool on a game format which includes a vertical component. Thus, the "rise to power" of the players can be better simulated by the game format while the players learn not only about potential abuse of power, but selected aspects of the history of American politics.

SUMMARY OF THE INVENTION

Objects of the Invention

It is an object of the present invention to provide game equipment which is educational, fun to play, and affords an enhanced and more interesting real life simulation.

Another object of the present invention is to provide game equipment in which the educational aspects are integrated into the play of the game in a manner which is entertaining.

Still a further object of the present invention is to provide game equipment which is easy to construct, durable and may be played by both old and younger players.

The game equipment of the present invention has other features and objects of advantage which will become apparent from and are set forth in more detail in the accompanying drawing of the following specification.

SUMMARY

The game equipment of the present invention includes chance determining means, ramp means formed with a plurality of steps therein providing game playing surfaces and a plurality of playing pieces formed for support on a movement over the steps during play of the game. The improvement in the game equipment of the present invention is comprised, briefly, of the ramp means being elongated and the steps extending substantially across the width dimension of the ramp means, and a plurality of side-by-side pathways defined on the steps and extending over the length of the ramp means. The passageways are preferably substantially parallel to each other and formed with distinct indicia thereon, with the playing pieces being provided as sets of a plurality of distinguishable playing pieces formed with distinct indicia thereon corresponding to the indicia on the pathways. The game equipment further preferably includes an information deck of cards, a question deck of cards and a detriment and benefit deck of cards.

DESCRIPTION OF THE PREFERRED EMBODIMENT

Figure 2:
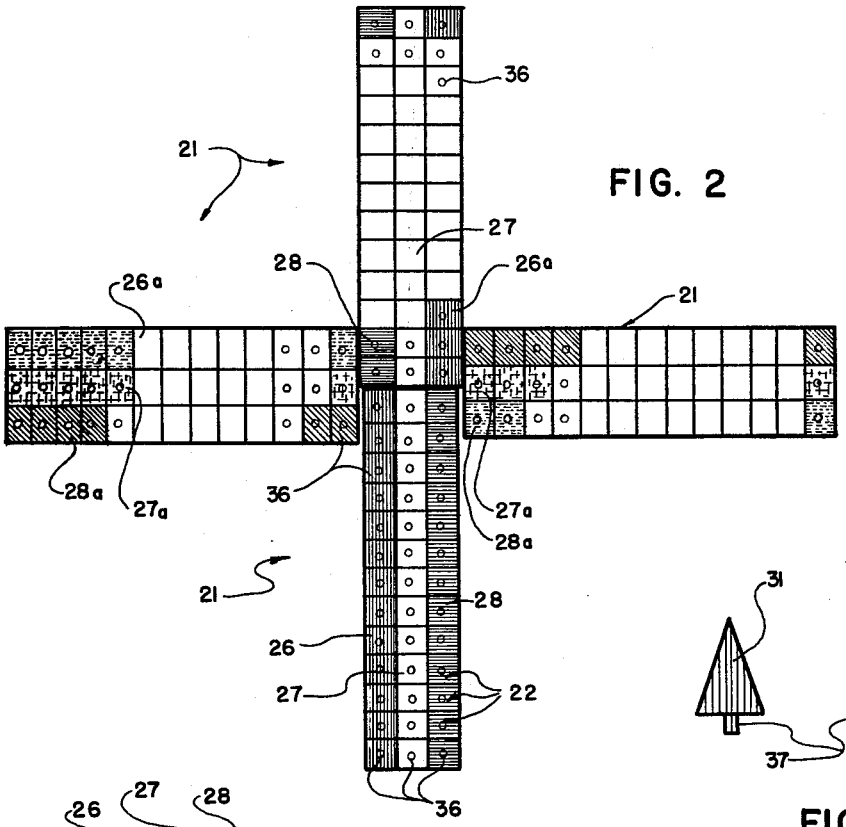
FIG. 2 is a top plan view of an array of four ramp means constructed as shown in FIG. 1 and placed together for play by four players.

The game equipment of the present invention includes as its most basic element a game format which takes the form of ramp means, generally designated 21, formed with a plurality of steps 22 providing the game playing surfaces over which play of the game proceeds. In addition to the ramp means, chance determining means, generally designated 23 (FIG. 4), and a plurality of playing pieces, generally designated 24 (FIG. 3), are also provided. Playing pieces 24 are formed for support on and movement over steps 22 during play of a game with the game equipment.

Figure 1:
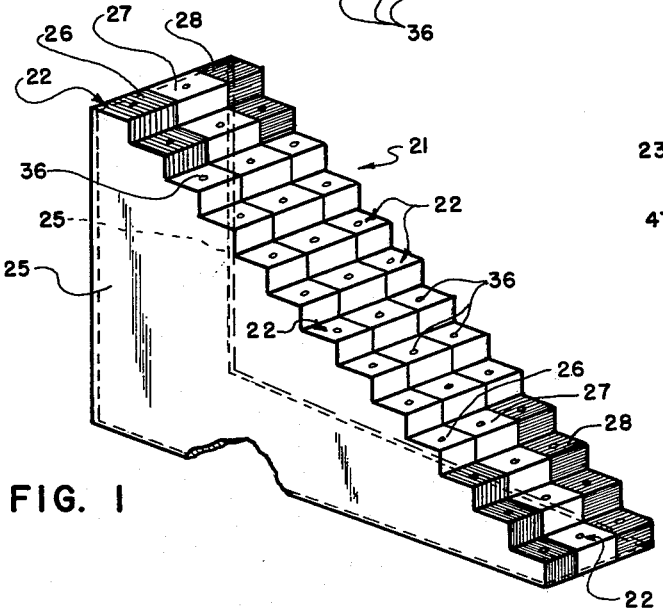
FIG. 1 is a top perspective view of ramp means constructed in accordance with the present invention.

The improvement in the game equipment of the present invention is comprised of the ramp means 21 being formed as an elongated member with steps 22 extending substantially across the width dimension of the ramp, and in this case completely across the width dimension of the ramp. Additionally, in the improved ramp means, a plurality of side-by-side pathways 26, 27 and 28 are defined on steps 22, which pathways extend over the length of ramp 21. Pathways 26, 27 and 28 are preferably substantially parallel to each other, equal in width and may advantageously be defined on steps 22 by distinct indicia, such as a color within the area constituting the path. As shown in FIG. 1, for example, pathway 26 is defined by the color red, while pathway 27 is white and pathway 28 is blue. This color combination of the three side-by-side pathways obviously lends itself to a game concerning American politics. As will be appreciated, however, other forms of indicia and other colors can be employed to define the plurality of pathways on ramp means 21.

As will be seen in FIG. 1, ramp means 21 may advantageously be formed with retention means on each of steps 22. Thus, retention means in the form of bores or recesses 36 dimensioned for receipt of the protruding portions or pegs 37 on the playing pieces can be employed as a matter of convenience so that the playing pieces will not be inadvertently bumped or knocked off of the ramp.

Figure 3:
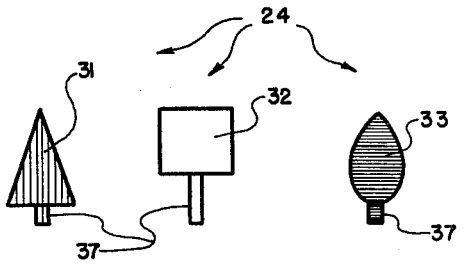
FIG. 3 is a side elevational view of a set of playing pieces suitable for use with the ramp means of FIG. 1.
Figure 4:
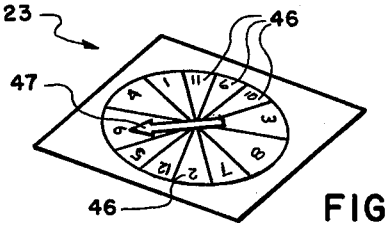
FIG. 4 is a top perspective view of chance determining means suitable for use with the present invention.
Figure 5:
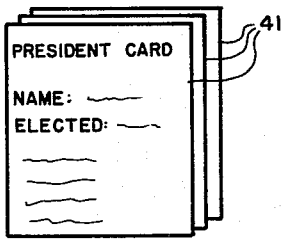
FIGS. 5, 6, and 7 are front elevational views of decks of cards suitable for use with the game equipment of the present invention.
Figure 6:
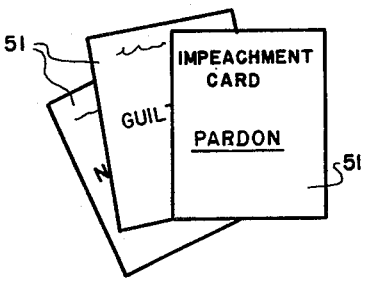
Figure 7:
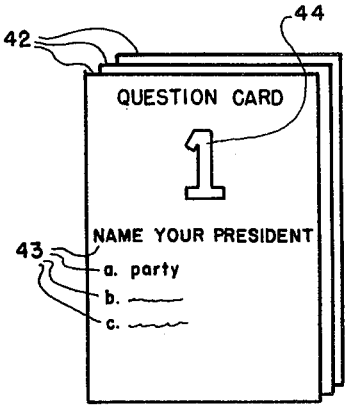

In order to key or relate playing pieces 24 to specific pathways on ramp means 21, the playing pieces are preferably provided as a set of playing pieces for each player, each set including a plurality of distinguishable playing pieces with each playing piece in the set having indicia thereon corresponding to the indicia on the pathways. Thus, a set of three playing pieces is shown in FIG. 3 which includes a conical playing piece 31 with a blue exterior surface corresponding to pathway 26, a square playing piece 32 having a white exterior surface corresponding to pathway 27, and a tear drop shaped playing piece 33 having a red exterior surface corresponding to red pathway 28. Thus, each of the playing pieces within the set is distinguishable by shape and each has color indicia thereon corresponding to color indicia on the pathways on ramp 21. In the preferred form of the game equipment of the present invention when used to play the CREDIBILITY game, each player's set of playing pieces includes seven playing pieces of three distinctive types as shown in FIG. 3 with one playing piece of a first type, for example playing piece 32, three playing pieces of a second type, for example playing piece 31, and three playing pieces of a third type, for example playing piece 33. Where plural playing pieces of a single type are provided, they are identical in shape and color indicia.

In order to provide an educational aspect to the use of the game equipment of the present invention, it is further preferable that the game equipment include a first deck of cards 41 provided with selected background information printed or otherwise formed on the cards. Cards 41 for the CREDIBILITY game are provided as "President Cards," and the first deck 41 is comprised of 38 cards, one for each president of the United States. The background information on the President Cards 41 can include such information as the name, party, year first elected, vice president, secretary of state, chief justice, state of birth, wife's name, names of children, etc. A second deck of cards 42 is also included which has questions relating to the background information on cards 41. These cards are herein referred to as "question cards." Question cards 42 are printed or otherwise formed with questions 43 which can be asked of the players relating to the information printed on the President Cards. The question cards 42 contain selected questions about some, but not all, of the background information on the President Cards. Thus, some question cards 42 may be more difficult to answer than others. In addition, question cards 42 have imprinted thereon indicia 44 which corresponds to the indicia 46 imprinted on chance determining means 23. As will be apparent, therefore, one can spin the pointer 47 of the chance determining means and use the chance determining means to randomly select indicia 46 which in turn determines which of question cards 42 are selected and used to question a player. The deck of question cards 42, therefore, normally is limited to the number of indicia 46 on the spinner or chance determining means 23. It should also be noted that question cards 42 do not have to include any questions and may simply direct a player to move a playing piece.

Finally, in the game equipment of the present invention, it is also preferable to have a third deck of cards 51 having benefits and detriments provided, usually by imprinting, thereon. In the CREDIBILITY game for which the game equipment of the present invention is particularly well suited, the detriment and benefit cards 51 are referred to as "impeachment cards" and include such detriments and benefits as a decision of "guilty," "not guilty" and "pardon."

Use of the game equipment of the present invention can be now described in play of the CREDIBILITY game. FIG. 2 shows an array of four elongated ramp means 21 each formed with three continuous, stepped, side-by-side pathways having color indicia thereon. The vertically oriented ramps 21 have identical color coding for pathways 26, 27 and 28. The horizontally extending ramp ways in FIG. 2 are also identical, but the color of the pathways *26a*, *27a* and *28a* have been selected to be gray, yellow and green respectively. It is contemplated in the array of FIG. 2 that players will play as partners sitting across from each other with the same color combinations on the ramp means 21 and on their corresponding playing pieces 24, but the color schemes are selected so that the respective partners can be distinguished.

The first step after assembling the ramp means together in the array with the highest of steps 22 being positioned in abutting relation to each other to form a common summit or uppermost level is for the President Cards 41 to be shuffled and placed face down with each player then drawing one of the President Cards. Each of the players then has a limited period of time in which to study his President Card, for example, seven minutes. President Card 41 is the passed to one of the player's opponents, for example, by each player passing his card to the right. The opponent keeps the President Card throughout the rest of the game. Each of the players now places a conical member 31 on pathway 26, or *26a*, with the conical member 31 representing a "secretary." Playing piece 32, representing the President, is placed on pathway 27 or *27a*. Finally, the tear drop shaped piece 33, representing a janitor, is placed upon the lowermost step of pathway 28 or *28a*. Spinner 23 can be used to determine who plays first, depending upon who gets the highest number. The first player then spins the spinner to select at random one of indicia 46. When the indicia has been selected, the corresponding question card 42 is removed from the question card deck and given to the player's opponent having the player's President Card. The opponent then reads the questions on question card 42, and the player must answer all of the questions in order to move a playing piece on the ramp. The order of moving of the playing pieces, however, is fixed, with the janitor playing piece 31 being moved first, the secretary playing piece 33 being moved second, and the President playing piece 32 being moved last. When a player answers all of the questions on a particular question card correctly, he may advance a playing piece one step. Thus, the first move would be to advance janitor playing piece 33 up one step, and the player's turn is then completed. Play moves to the opponent who spins the spinner 23 and hands the appropriate question card to the partner of the first player who then asks the opponent the questions on the question card.

As was indicated hereinabove, question cards 42 may also contain directions with respect to movement of the playing pieces. For example, question card no. 5 might merely indicate "move your President one space backward." Question card no. 6 might indicate "advance each piece one space," while question card no. 7 might indicate "you must forfeit one of your janitors for the war cause." At least one of the question cards would provide the instruction "your President is being impeached." As will also be appreciated, these instructions could be provided directly on spinner 23, with question cards 42 being reduced to solely those cards which have questions thereon.

Play of the game continues in turn around the array of ramps with each player seeking to move his President piece 32 to the uppermost step in pathway 27 or 27*a*. The first player to reach the uppermost step wins the game for his team.

There are two types of plays, however, that can drastically upset a player's march to the top of his ramp. The first of these is when a player spins the impeachment number. If a player should spin the impeachment number, he can either resign or elect to be tried by the senate. The trial does not take place, however, until the player has passed three turns. After passing three turns, the player on the fourth turn draws one card from the deck of the impeachment cards 51. There are three "pardon" cards, seven "guilty" cards and seven "not guilty" cards comprising the deck of impeachment cards 51. If a player should draw a "pardon" card, he must resign, but his partner is allowed to advance three steps for each of his pieces. If the player draws a "guilty" card, he is out of the game. If a player draws a "not guilty" card, he may continue play.

The second typs of play which can disrupt a player's march to the top of his ramp, is the Credibility move. It is essential during play of the CREDIBILITY game that the player protect his President's right side, namely, the pathway 28 or 28*a* on which the janitor piece 33 moves. The janitor piece therefore acts as a "cover" for the President, and, accordingly, it is important for the President's "cover" to reach each level as soon as possible. If all of the players have their playing pieces on the third step up from the bottom, and one of the players is entitled to move his janitor piece 33 up to the fourth step, the first player to reach the fourth step with his janitor piece has control of that fourth step over his opponent. This control means that the janitor on the fourth step can be moved over to his opponent's ramp on the fourth step to take a janitor piece which arrives at the fourth step after the first player. If this occurs, the opponent has had his "cover blown" and if the President piece is also on the fourth step when it occurs, the player's opponent will lose his President piece unless he makes the Credibility move. The Credibility move is for the opponent to exchange the position of his President and his secretary, which must also be on the fourth step, so that the secretary now protects the opponent from the first player's janitor. The Credibility move, however, can only be made once by a player during the game. Moreover, it can be made when the player correctly or incorrectly answers the questions on the question card, but cannot be made unless the secretary piece is also on the same level with the President piece. If during play of the game a player should lose all of his janitor pieces, for example by spinning the spinner 23 so as to land on a number which requires forfeiture of a janitor piece or if an opponent has moved across and taken a janitor piece, then the player will not be able to force his opponent to make the Credibility move. Conversely, if the player has lost all of his secretary pieces, he will be unable to make the Credibility move to escape a janitor piece which is moved from ramp to ramp by an opponent.

Instead of using the Credibility move to avoid an opponent's janitor piece when it has been moved to a player's ramp and captured the player's own janitor piece, it is also possible, when playing as partners, for a partner's secretary piece to be moved in a defensive move to take the opponent's janitor piece if the partner's secretary piece is on the same level as the opponent's janitor piece. This use of the partner's secretary piece in a defensive manner can be made regardless of the order in which the secretary piece and the opponent's janitor piece reached the same level or step.

As will be appreciated, it is possible for four players to play as individuals, rather than teams, and the game equipment of the present invention can be played by two players with the ramps opposed, or in side-by-side arrangement.

The game equipment of the present invention can be advantageously formed of plastics or impregnated paper or cardboard materials. Ramp means 21, when a plurality of ramps are employed, can advantageously be formed so that each of the ramp means is hollow and of a slightly different transverse dimension so that the ramp means can be stored one inside the other in nested relation. Thus, in FIG. 1, the side walls 25 of the ramp means define a hollow space underneath steps 22 into which a ramp means of slightly less width dimension can be positioned. As seen in FIG. 2, the ramp means 21 are each formed with differing widths to permit nesting during storage. Alternatively, the ramps can be formed with step portions and side portions which are selectively detachable from each other to provide compactness. One way of doing this would be to provide the steps with an L-grooved under surface into which the side portions can be slidably mounted. The L-groove would hold the side portions during play, but permit disassembly for storage. Finally, the playing pieces 24 can be formed of wood, metal, plastic or any other material coventionally used for parlor game playing pieces.

What is claimed is:

1. Game equipment for playing a game including chance determining means, at least one elongated ramp means formed with a plurality of steps extending substantially across the width dimension of said ramp means to provide game playing surfaces; a plurality of side-by-side substantially parallel pathways defined on said steps, said pathways being formed with distinct indicia thereon; and a plurality of playing pieces provided as a set for each player with each playing piece having a distinct indicia thereon corresponding to said indicia on said pathways, wherein the improvement in said game equipment is comprised of:

said game equipment includes at least two independently movable elongated ramp means each formed with three continuous stepped side-by-side pathways thereover, said ramp means being further formed for positioning in an array with a highest of said steps of each of said ramp means in close juxtaposed relation to the highest steps of the remainder of said ramp means.

2. Game equipment as defined in claim 1, and a first deck of cards having a background information thereon for each president of the United States, a second deck of cards provided with questions thereon relating to said background information, and a third deck of cards having benefits and detriments provided thereon.

3. Game equipment as defined in claim 1, wherein, each player of said game is provided with a set of seven playing pieces of three distinctive types including one playing piece of a first type, three playing pieces of a second type and three playing pieces of a third type.

4. Game equipment as defined in claim 1 wherein, a first of said ramp means is formed as a hollow member having an open end and a second of said ramp means is dimensioned for positioning in nested relation to said first of said ramp means.

* * * * *